US007048369B2

(12) United States Patent
Rousseau et al.

(10) Patent No.: US 7,048,369 B2
(45) Date of Patent: May 23, 2006

(54) ELECTROSTATIC GROUNDING FOR DRUM MAINTENANCE UNIT

(75) Inventors: Gerard H. Rousseau, Portland, OR (US); Ernest I. Esplin, Sheridan, OR (US); Kelly Kessler, Wilsonville, OR (US)

(73) Assignee: Xerox Corporation, Stamford, CT (US)

( * ) Notice: Subject to any disclaimer, the term of this patent is extended or adjusted under 35 U.S.C. 154(b) by 212 days.

(21) Appl. No.: 10/707,574

(22) Filed: Dec. 22, 2003

(65) Prior Publication Data

US 2005/0134630 A1 Jun. 23, 2005

(51) Int. Cl.
*B41J 2/01* (2006.01)

(52) U.S. Cl. ..... 347/103; 347/84; 347/88

(58) Field of Classification Search ..... 347/103, 347/22, 33, 36; 118/60
See application file for complete search history.

(56) References Cited

U.S. PATENT DOCUMENTS 5,372,852 A 12/1994 Titterington et al. ..... 427/288
5,389,958 A * 2/1995 Bui et al. ..... 347/103
5,805,191 A 9/1998 Jones et al. ..... 347/103
5,808,645 A 9/1998 Reeves et al. ..... 347/103
6,068,372 A 5/2000 Rousseau et al. ..... 347/103
6,176,575 B1 1/2001 Crawford et al. ..... 347/103

FOREIGN PATENT DOCUMENTS

JP 2002052749 A * 2/2002
JP 2002116630 A * 4/2002
JP 2002283546 A * 10/2002
JP 2002292839 A * 10/2002

OTHER PUBLICATIONS

Machine translation of JP 2002283546 to Arai from Japanese Patent Office website.*

* cited by examiner

*Primary Examiner*—Daniel J. Colilla
(74) *Attorney, Agent, or Firm*—Oliff & Berridge, PLC

(57) ABSTRACT

A drum maintenance unit (drum maintenance unit) to reduce build up of electrostatic charge within a printer device. The drum maintenance unit may have a static shield positioned to reduce the build up of an electrostatic charge and to act as a physical barrier by preventing discarded oil from becoming airborne and returning to the oiling roller unfiltered. The static shield may also be utilized to retain and house the filtration system of the drum maintenance unit thus reducing part count and manufacturing time.

20 Claims, 6 Drawing Sheets

ELECTROSTATIC GROUNDING FOR DRUM MAINTENANCE UNIT

BACKGROUND OF THE INVENTION

1. Field of Invention

The present invention relates to printing, and more particularly to a shield provided in a Drum Maintenance Unit.

2. Description of Related Art

U.S. Pat. No. 6,068,372 to Rousseau et al. (hereinafter "the 372 patent") discloses a replaceable liquid application system for applying a liquid intermediate transfer surface to a support surface in a printer. The liquid application system is contained in a removable cassette and utilizes a liquid impregnated arcuate surface that engages the support surface by rolling contact. The liquid impregnated arcuate surface is contained in a removable cartridge in the cassette. A cartridge life status assembly determines when the useful life of the cartridge has been exhausted. Push tabs on the cartridge and finger wells on the cassette allow for easy and convenient removal of a used cartridge and insertion of a replacement cartridge.

In the 372 patent, the cartridge also contains a reclamation assembly that extends the useful life of the cartridge. The reclamation assembly reclaims liquid from the support surface, filters the liquid and supplies the reclaimed liquid back to the arcuate surface for reapplication to the support surface.

Current solid ink printers use an oil impregnated roller and metering blade as active components of their Drum Maintenance Unit (DMU). The oiling roller comes in contact with an imaging drum of a printer device to transfer a release agent (silicone oil) onto the drum. A metering blade then wipes the drum clean by removing the oil, any non-transferred ink, and other particle debris. The metering blade then retracts and the used oil and collected waste is then transferred to a filtration system to filter out the waste and reclaim the oil for future use.

SUMMARY OF THE INVENTION

Solid ink printers using this type of roller and blade combination have used a metal chassis in the past. Although, to reduce cost in manufacturing and the weight of the drum maintenance unit a plastic chassis has been utilized.

However, the plastic chassis brings a set of new problems. As the metering blade is in close proximity to the oiling roller, it has been found that the plastic chassis acts as an electrical insulation.

FIG. 1 shows one of the problems of solid ink printers. After an imaging drum 10 transfers the image to the substrate (not shown) some non-transferred ink 15 remains on the drum 10. An oiling roller 20 transfers a release agent or oil 19 at a roller/drum nip 12 to prepare the drum 10 for the next job cycle. As the oil 19 has very good dielectric properties, an electrostatic charge is formed immediately after the roller/drum nip 12. As the drum 10 and the roller 20 separate from one another, the oil 19 takes a certain polarity charge 17, e.g., positive. The oil 19 remaining on the oiling roller 20 retains an opposite charge, e.g., negative. Accordingly, an electrostatic field is formed in the region between the oiling roller 20, the drum 10 and a metering blade 30 that may potentially cause several problems.

Without releasing the electrostatic charge, the charge builds up with the potential of causing an electrostatic discharge or arc to occur. The arc may potentially affect neighboring electrostatically sensitive systems and may cause a system malfunction and/or premature failure of parts within the printer. Also, as the printing speed of the printer continues to increase, the electrostatic charges amplitude will also increase. Hence, more severe damage to the printer may result due to the increase in charge.

As the drum 10 continues through its cycle, the oil 19 retaining the charge 17 is partially scraped or wiped by the metering blade 30 to remove the oil 19 and the non-transferred ink 15, collectively referred to as discarded oil 21. The discarded oil 21 is then transferred to a filter system (not shown) to filter out any particles and debris and reclaim the oil 19.

Moreover, with the oil on the oiling roller 20 having charge 16 and the oil on metering blade 30 having opposite charge 17, the discarded oil 21 may become airborne and jump back onto the oiling roller 20 as illustrated at 29. If this continues over a period of time and the ratio of ink 15 is sufficiently large, ink 15 will build up on the surface of the oiling roller 20. In some cases, the ink 15 can clog the oiling roller and diminish the roller's 20 ability to transfer the oil 19 to the imaging drum 10. As a result, the oiling roller 20 may prematurely fail.

The discarded oil 21 may also become airborne and return to the oiling roller 20 when the metering blade 30 is disengaged at the end of each oiling cycle. At the end of the oiling cycle, the oiling roller 20 and the metering blade 30 are in close proximity 29 to one another. As roller 20 and metering blade 30 are at different potentials, an electrostatic field exists that allows the possibility for the discarded oil 21 to become airborne and cross the narrow gap, illustrated at 29, back onto the roller 20.

In either of the above incidents, undesirable oil or ink spots can appear on the surface of a print job and premature failure of the oiling roller 20 can occur.

Thus, there is a need for a solution that will diminish the electrostatic charge and prevent the discarded oil from returning to the oiling roller.

This invention provides a device for reducing the build up of static charge in a solid ink printer.

This invention separately provides a device that reduces the amount of oil becoming airborne and returning to the oiling roller.

This invention separately provides a device that is in contact with the oiling roller to reduce the electrostatic charge of the oiling roller.

This invention separately provides an electrostatic shield between the oiling roller and the metering blade to reduce the build up of the electrostatic field.

This invention separately provides a shield to house a filter.

This invention separately provides a cost efficient solution for the build up of the electrostatic field.

This invention separately provides an electrical ground for a static shield.

According to various exemplary embodiments of this invention, a drum maintenance unit includes a casing that houses an oiling roller, a metering blade and a shield. In various exemplary embodiments, the shield may be placed between the oiling roller and the metering blade and function as an electrostatic shield. In other exemplary embodiments, the shield may function as a physical barrier between the oiling roller and the metering blade.

In various exemplary embodiments, the shield extends the length of the oiling roller.

In various exemplary embodiments, the shield is in contact with the oiling roller.

In various exemplary embodiments, the shield is electrically grounded. In other exemplary embodiments the shield is grounded to a media device when the drum maintenance unit is installed in the media device.

In various exemplary embodiments, the shield comprises a conductive material.

In various exemplary embodiments, the shield partially encases the oiling roller.

In various exemplary embodiments, the shield has a distal end that extends between the oiling roller and an imaging drum of the media device when the drum maintenance unit is installed in the media device.

In various exemplary embodiments, the shield may have a filter portion that retains a filter and a guard portion placed between the oiling roller and the metering blade. In other exemplary embodiments, the shield may have an L shape.

In various exemplary embodiments, the casing of the drum maintenance unit has a reservoir. In other exemplary embodiments, the filter portion of the shield is housed in the reservoir.

In various exemplary embodiments, the shield has filter pockets. In other exemplary embodiments, the shield may have tabs to retain the filter to the shield.

In various exemplary embodiments, a method of reducing ink transfer to the oiling roller is utilized by providing a shield between the oiling roller and the metering blade. In other exemplary embodiments, a method of grounding the shield is provided. In still other exemplary embodiments, a method of reducing the electrostatic charge is provided.

BRIEF DESCRIPTION OF THE DRAWINGS

Various exemplary embodiments of this invention are described in detail below, with reference to the attached drawing figures, in which.

DETAILED DESCRIPTION OF EXEMPLARY EMBODIMENTS

In various exemplary embodiments of this invention, the drum maintenance unit is provided with an electrostatic shield between the oiling roller and the metering blade, to reduce the electrostatic charge when the drum maintenance unit is installed in a media device. The electrostatic shield has a guard portion that is allowed to come in contact with the oiling roller so as to take up the charge that the roller may have after coming in contact with the imaging drum of the media device. The static shield may be coupled to the media device ground so as to bleed the static charge build up in the region between the oiling roller and the metering blade.

In like manner, the metering blade may be also coupled to the media device ground to further reduce the static charge build up.

In this manner, the static shield prevents an build up of electrostatic charge. The shield may also function as a physical barrier to prevent the discarded oil from becoming airborne and contacting the oppositely charged oiling roller. Thus, the static shield may maintain the integrity of the oiling roller and also prevents damage to neighboring systems.

According to various embodiments of this invention, the static shield may also have a lower portion that retains a filter of the filtration system of the drum maintenance unit. The lower portion may be placed in the reservoir and may abut the lower inner bottom of the drum maintenance unit casing. In this manner, the filter may contact the oiling roller to allow the reclaimed oil to be transferred and reused on the oiling roller.

By having the static shield perform these various functions, both the part count and time for manufacturing can be reduced.

Figure 1:
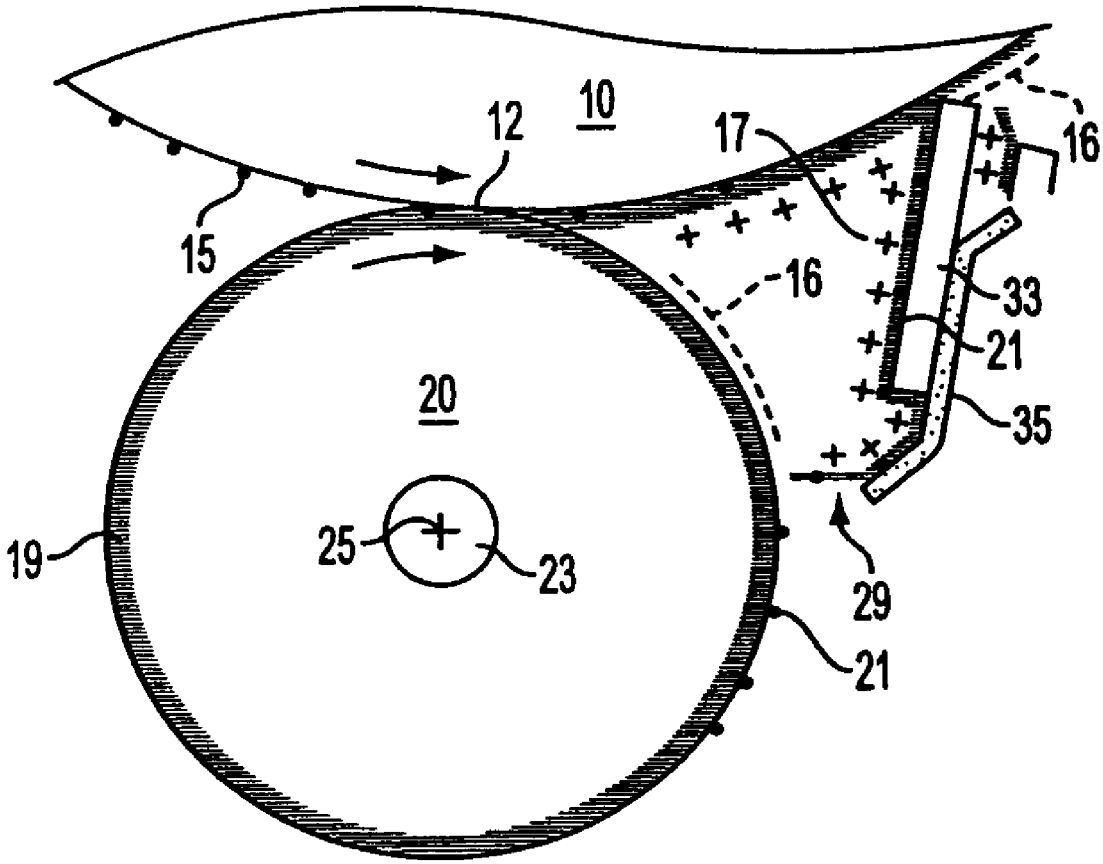
FIG. 1 a cross sectional view of the arrangement of an oiling roller, a drum and a metering blade.
Figure 2:
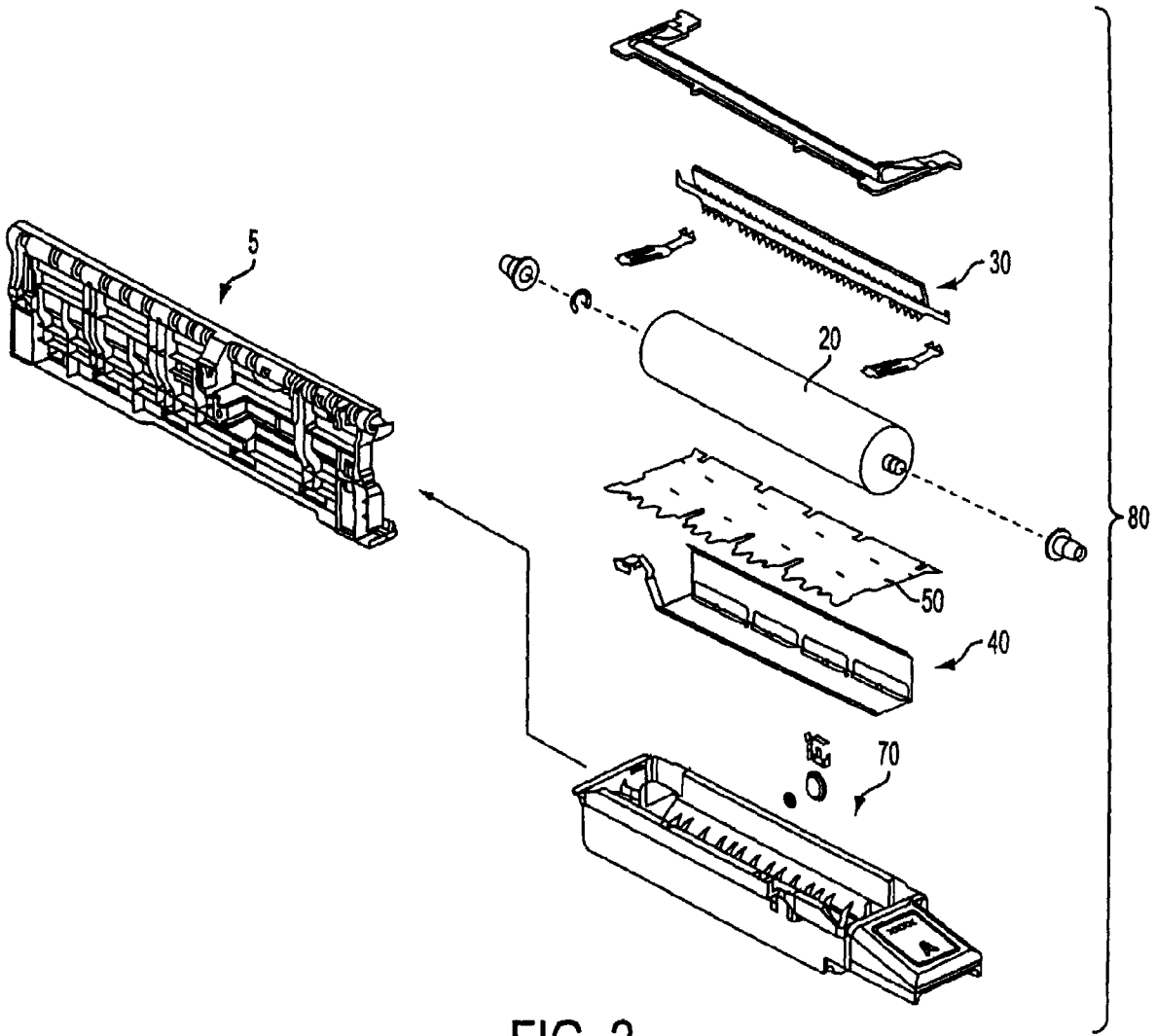
FIG. 2 is an exploded perspective view of an exemplary arrangement of a drum maintenance unit prior to being installed in a receiving portion of a media device.

FIG. 2 shows an exemplary embodiment of a drum maintenance unit 80 in an unassembled state. The components of the drum maintenance unit 80 such as the metering blade assembly, the oiling roller, the filter and the shield are described in copending U.S. application Ser. Nos. 10/740,461, 10/707,572, 10/707,573 and the present application. The assembled drum maintenance unit 80 maybe inserted as indicated within a receiving portion 5 of the media device, only the receiving portion 5 being shown. According to this configuration, drum maintenance unit 80 comprises static shield 40 to reduce the electrostatic charge and also to retain the filter 50.

Figure 3:
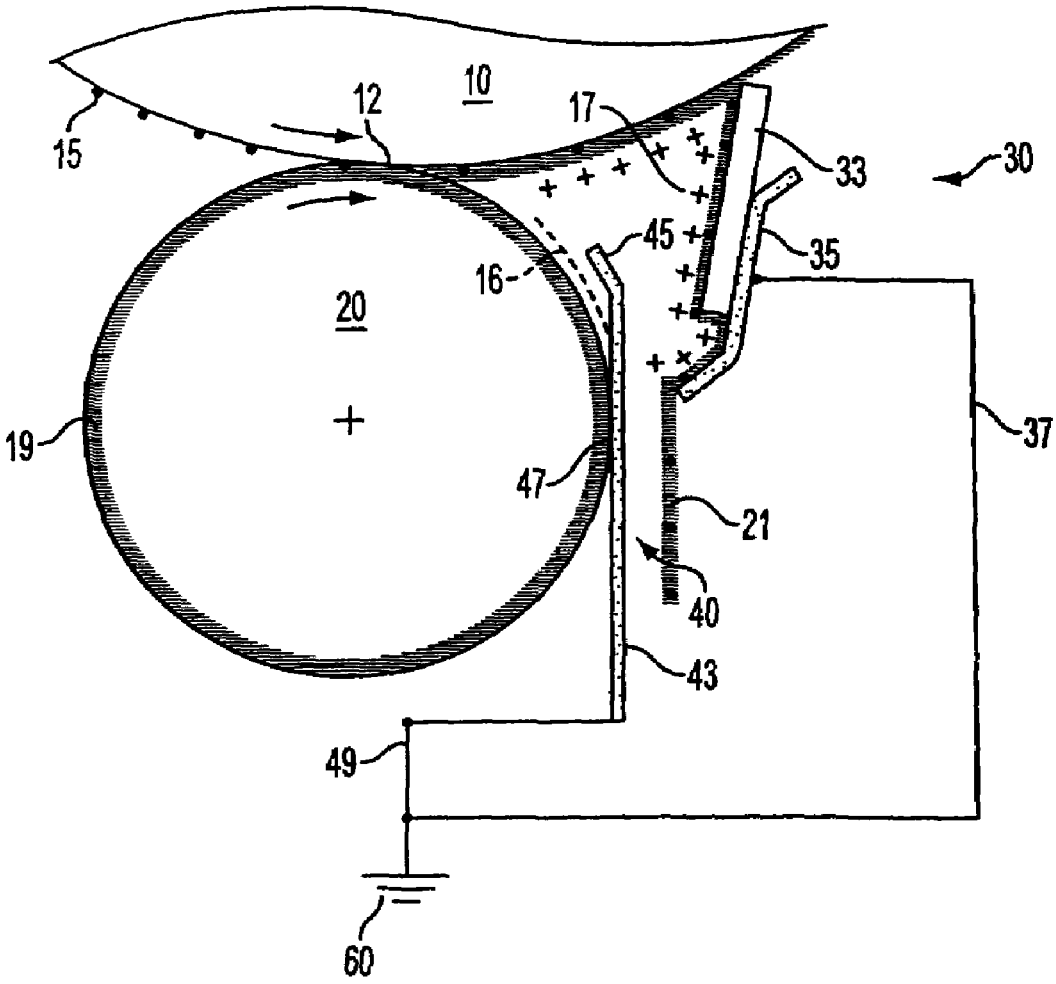
FIG. 3 is a cross sectional view of a first exemplary embodiment according to this invention wherein a static shield is provided between the oiling roller and the metering blade.

FIG. 3 shows an exemplary embodiment of the static shield 40 within the drum maintenance unit 80 (only a portion is shown) in contact with an imaging drum 10 of the media device. According to this configuration, the static shield 40 can be placed in the area of the electrostatic field. In this embodiment, the static shield 40 may be placed between the oiling roller 20 and the metering blade 30 and may extend the longitudinal length of the oiling roller 20. The static shield 40 may have a guard portion 43 that extends between the roller 20 and the blade 30 and contacts the oiling roller 20 at a contact region 47. The contact region 47 may allow the static shield 40 to further diminish the negative charge 16 on the oiling roller 20 by taking up the charge.

The charge may be taken up, for example, by providing a ground connection 49 for the static shield 40 and coupling the ground connection 49 with a media device ground 60. One possible configuration is coupling the ground connection 49 with a metering blade ground 37 so as to reduce the electrostatic field in the drum maintenance unit. The coupling of the shield 40 and the blade ground contacts with the receiving portion ground (not shown). The receiving portion ground is coupled to the metal shaft of the receiving portion. The metal shaft is provided with a ground clip that is coupled to the media device ground. In this manner, the electric potential between the oiling roller 20 and the metering blade 30 may be reduced.

One skilled in the art will appreciate that various configurations exist to provide a ground for the drum maintenance unit. This is only one possible illustration of how the ground connection may be achieved.

The static shield 40 may be made of any material or combination of materials that possess conductive properties. Some of the materials may include, steel, copper, and aluminum.

In another exemplary embodiment, the static shield 40 may function as a physical barrier for the discarded oil 21. As described above, the metering blade 30 wipes or scrapes the discarded oil 21 off the imaging drum 10. The discarded oil 21 may still carry a charge in route to the filtration system of the drum maintenance unit 80. However, the physical barrier provided by the static shield 40 can diminish the ability of the discarded oil 21 from contacting the oiling roller 20. As previously mentioned, the shield 40 takes up the charge of the roller 20 created at the roller/drum nip 12. If an electrical potential is present and discarded oil 21 becomes airborne, the shield 40 may function as a physical barrier preventing the discarded oil 21 from contacting the roller 20. Thus, the roller 20 is protected and the discarded oil 21 is safely transferred to the filtration system (not shown).

In an exemplary embodiment, the static shield 40 may be provided with a tab 45 at a distal end. The tab 45 may be bent toward the roller 20 to more closely conform to the shape of the oiling roller 20. Also, the tab 45, thanks to its longitudinal bend, may further help straightening and stiffening the guard portion of the shield 40, consequently ensuring contact in the area 47 between the roller 20 and the shield 40. Additionally, several tabs may be used for the static shield to more closely conform to the shape of the roller 20.

FIGS. 4–7 show another exemplary embodiment of a static shield 400 housed within the drum maintenance unit casing 70. Like features retain same reference number and generally operate as previously discussed.

Figure 4:
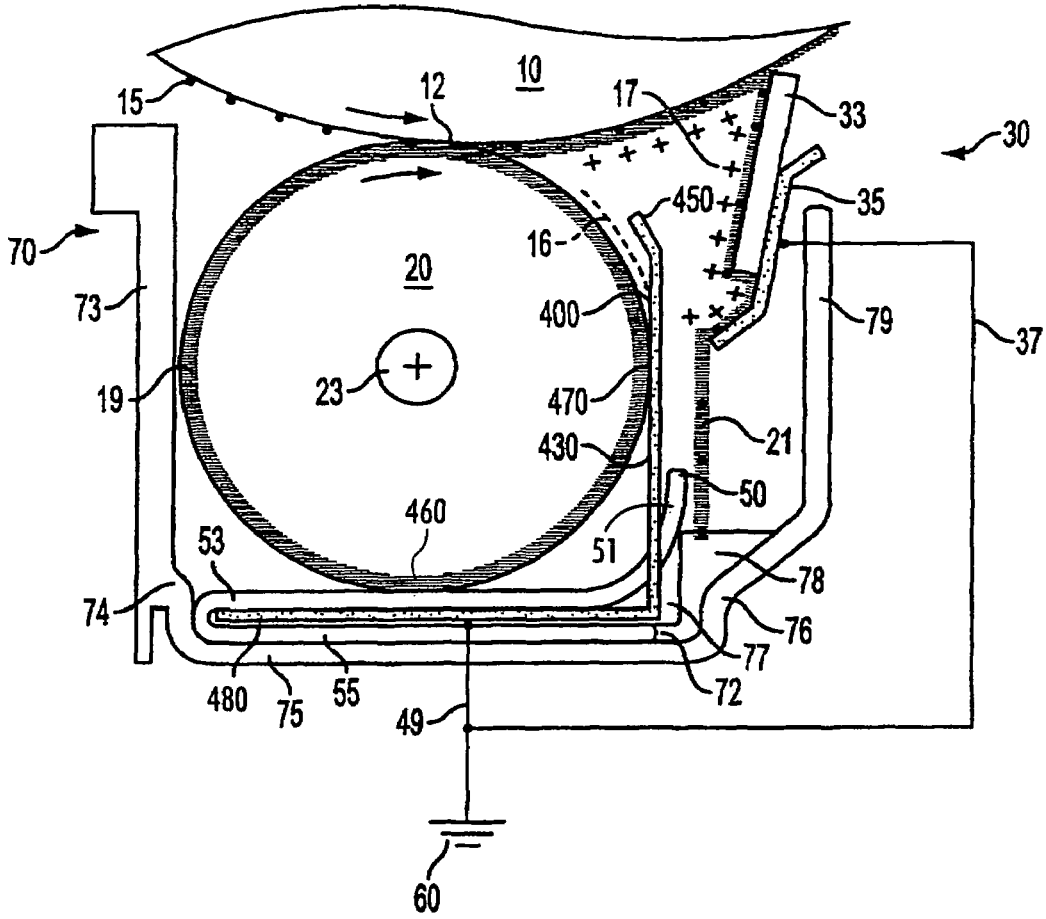
FIG. 4 is cross sectional view of a second exemplary embodiment according to this invention wherein a static shield houses a filtration system.
Figure 5:
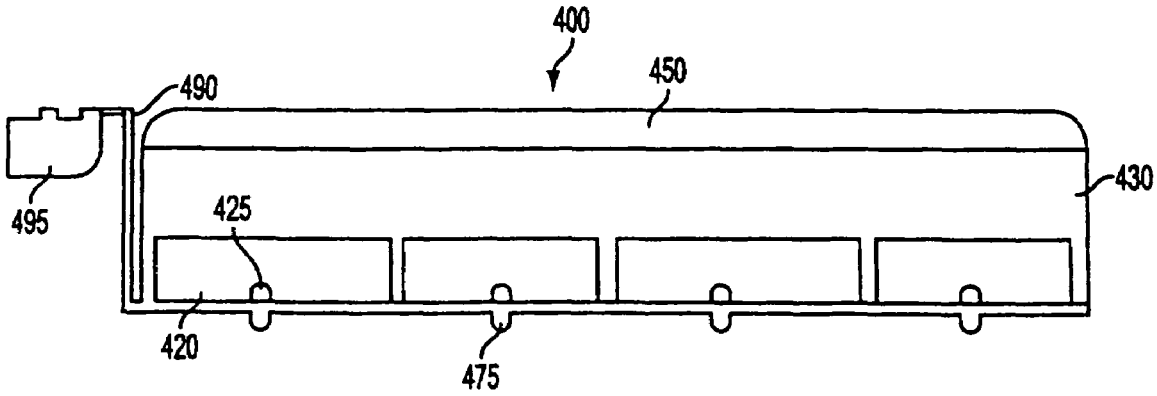
FIG. 5 is a front perspective view of an exemplary embodiment of the static shield shown in FIG. 4.
Figure 6:
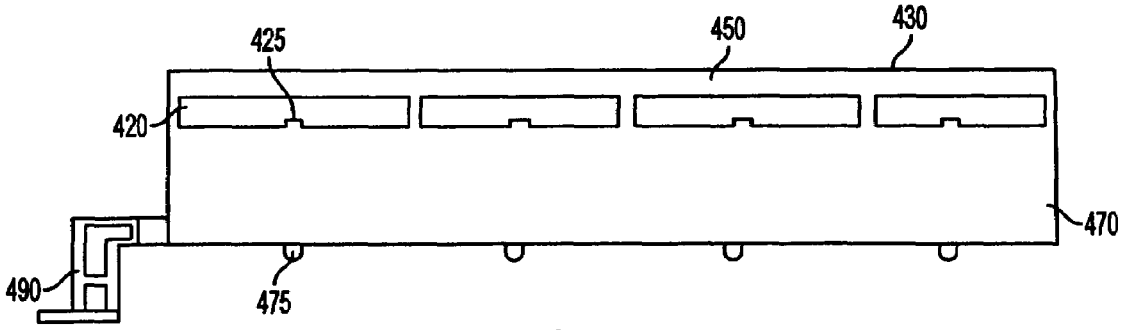
FIG. 6 is a top perspective view of the exemplary static shield of FIG. 5.

In this embodiment static shield 400 has a general L shape with a guard portion 430 and a filter portion 480, as shown in FIG. 4.

In this embodiment, drum maintenance unit casing 70 is defined a the left wall 73, a bottom surface 75 and a right wall 79 to house the various components of the drum maintenance unit 80.

The static shield 400 functions in the same manner as the static shield 40 described in FIG. 2. Although, the static shield 400 now also retains a filter 50. With this additional function of the static shield 400, reduction in both part count and manufacturing time may be achieved.

The static shield 400 has an upper portion 430 and a filter portion 480. In this arrangement, the filter portion 480 extends between the oiling roller 20 and the bottom surface 75 of drum maintenance unit casing 70. In addition, tabs 78 and bottom steps 72 (only one shown) are provided to position the static shield 400 within the casing 70. The upper portion 430 and the filter portion 480 are arranged such that when the DMU 80 is assembled, static shield 400 is wedged between the roller 20 and the casing 70 to produce a reaction force on the roller 20. The reaction force maintains roller contact at points 470 and 460.

Still referring to FIGS. 4–7, an exemplary embodiment of how the filter 50 may be retained on the static shield 400 will now be described. The filter 50 has an upper end 51 that is fed through filter pockets 420 (shown in FIG. 7) of the static shield 400. By wedging the filter 50 through the filter pockets 420, the filter 50 is retained in a cost effective manner.

In addition, pocket tabs 425 (shown in FIGS. 5–7) may be provided to assist in retaining the filter 50 on the static shield 400. The pockets tabs 425 may be located at an edge of filter pockets 420 and oriented to prevent the filter 50 from sliding off the static shield 400 as the roller 20 rotates through a job cycle.

To further assist in housing the filter 50, the filter portion 470 may have filter tabs 475. In this exemplary embodiment, the filter tabs 475 are located near a distal end of the filter portion 470. Like the pocket tabs 425, the tabs 475 are fed through a small slit in the filter 50 and oriented so as to prevent the filter 50 from sliding off the static shield 400.

In an exemplary embodiment, the static shield 400 is positioned so as to be between an upper filter portion 53 and a bottom filter portion 55, as shown in FIG. 3. With this arrangement, the filter portion 470 and the filter 50 are housed within the bottom region 77 which is defined respectively by the left and right ledges 74, 76.

With the arrangement of the static shield 400 and the filter 50, the discarded oil 21 passes through the filter 50 so as to separate any unwanted particles from the reclaimed oil 19. The reclaimed oil 19 then travels to the upper portion 53 of the filter 50 to be applied once again on roller 20 at contact portion 460.

Figure 7:
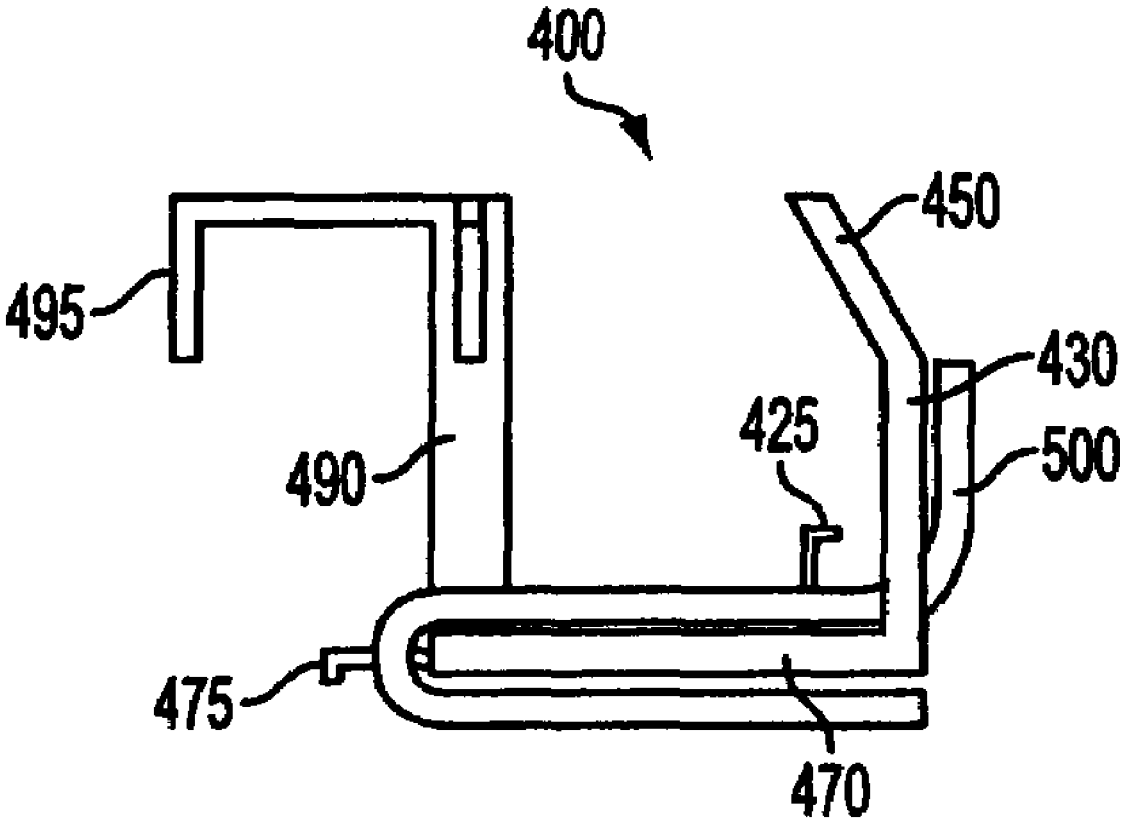
FIG. 7 is a side view of the exemplary static shield of FIG. 5 retaining a filter.

FIG. 7 shows an exemplary embodiment of this invention, showing static shield 400 and filter 500. A distal end of the filter 500 is fed through an opening of static shield 400 (not shown). The remaining portion of filter 500 may be draped above and below lower portion 470 as shown. Shield 400 may be provided with tabs 425 and 475 that may be inserted through slits of filter 500 (not shown). Tabs 425 and 475 may be oriented to assist in retaining the filter 500 onto the static shield 400 as the filter may also contact with the oiling roller 20. Also shown in FIG. 7 is ground extension 490 and ground contact 495 for drawing away a build up of an electrostatic potential. Though one skilled in the art will recognize that grounding 490 may have a different configuration so long as it draws away an electrostatic potential.

While this invention has been described in conjunction with exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention. For example, the static shield may have a C shape, the static shield may be designed to surround the metering blade instead of the oiling roller, the filter may be retained to the static shield by an adhesive, and the filter may be placed anywhere on the static shield to filter the discarded oil.

The invention claimed is:

1. A drum maintenance unit, comprising:

a casing;

an oiling roller housed within the casing;

a metering blade housed within the casing and spaced from the oiling roller; and a shield disposed between the oiling roller and the metering blade, wherein the shield comprises a conductive material.

2. The drum maintenance unit according to claim 1, wherein the shield reduces electrostatic field build up when the drum maintenance unit is installed in a media device.

3. The drum maintenance unit according to claim 1, wherein the shield comprises a physical barrier between the oiling roller and metering blade.

4. The drum maintenance unit according to claim 1, wherein the oiling roller has a longitudinal length and the shield extends at least the longitudinal length of the oiling roller.

5. The drum maintenance unit according to claim 1, wherein the shield is in contact with the oiling roller.

6. The drum maintenance unit according to claim 1, wherein the shield is electrically grounded.

7. The drum maintenance unit according to claim 1, wherein the shield is electrically grounded to a media device when the drum maintenance unit is installed in the media device.

8. The drum maintenance unit according to claim 1, wherein the shield partially encases the oiling roller.

9. The drum maintenance unit according to claim 1, wherein the shield generally has an L shape.

10. The drum maintenance unit according to claim 1, wherein an end of the shield is bent toward the oiling roller.

11. The drum maintenance unit according to claim 1, further comprising a filter.

12. The drum maintenance unit according to claim 11, wherein the shield comprises a filter portion that retains the filter.

13. The drum maintenance unit according to claim 12, wherein the casing comprises a reservoir that houses the filter and a lower portion of the shield.

14. The drum maintenance unit according to claim 1, further comprising a release agent retained on the oiling roller.

15. The drum maintenance unit according to claim 11, wherein tabs are provided on the shield to retain the filter.

16. The drum maintenance unit according to claim 1, wherein an upper portion of the shield is in contact with the oiling roller.

17. A method for reducing ink transfer to an oiling roller in a drum maintenance unit, comprising:

providing a static shield between the oiling roller and a metering blade.

18. The method for reducing ink transfer according to claim 17, further comprising electrically grounding the shield.

19. The method for reducing ink transfer according to claim 17, further comprising contacting the oiling roller with the shield to reduce an electrostatic charge on the oiling roller.

20. A drum maintenance unit, comprising:

a casing;

an oiling roller housed within the casing;

a metering blade housed within the casing and spaced from the oiling roller; and a static shield disposed between the oiling roller and the metering blade.

* * * * *